US005660713A

United States Patent [19]

Pillet

[11] Patent Number: 5,660,713

[45] Date of Patent: Aug. 26, 1997

[54] JUMPER SWITCH MEANS FOR ELECTROLYZERS ELECTRICALLY CONNECTED IN SERIES

[75] Inventor: Michel Pillet, Saint-Cezaire-sur-Siagne, France

[73] Assignee: De Nora Permelec S.p.A., Italy

[21] Appl. No.: 272,248

[22] Filed: Jul. 8, 1994

[30] Foreign Application Priority Data

Jul. 20, 1993 [IT] Italy ..... MI93A1592

[51] Int. Cl.[6] ..... C25B 9/04

[52] U.S. Cl. ..... 205/516; 204/228

[58] Field of Search ..... 204/228, 1.11, 204/98; 205/516

[56] References Cited

U.S. PATENT DOCUMENTS

| | | | |
|---|---|---|---|
| 4,324,634 | 4/1982 | Kircher | 204/228 |
| 4,390,763 | 6/1983 | Hruda | 200/144 B |
| 4,589,966 | 5/1986 | Ford | 204/228 |
| 5,207,883 | 5/1993 | Borrione | 204/228 |

*Primary Examiner*—Donald R. Valentine
*Assistant Examiner*—Brendan Mee
*Attorney, Agent, or Firm*—Bierman and Muserlian

[57] ABSTRACT

The novel jumper switch means of the invention is directed to by-passing an electrolyzer in a row of electrolyzers electrically connected in series to permit removal of the by-passed electrolyzer for maintenance. The jumper switch means comprises one or more internal bus bars connected to suitable arrays of switches, the internal bus bars being dimensioned in such a way that when substantially all the electrolysis current flows through the jumper switch means, the voltage at its two connection terminals and therefore at the contact points of the by-passed electrolyzer, is close to, but in any case lower than the voltage spontaneously reached by the electrolyzer when electrolysis current is no more fed. Further, the present invention offers the possibility of housing the array of switches and said internal bus bars in a structure having a U-shape wherein the planar part has a limited height which does not hinder the lateral removal of the by-passed electrolyzer by a suitable fork-lift truck.

2 Claims, 4 Drawing Sheets

JUMPER SWITCH MEANS FOR ELECTROLYZERS ELECTRICALLY CONNECTED IN SERIES

BACKGROUND OF THE INVENTION

The industrial products of greatest interest in the electrochemical field, that is chlorine and caustic obtained by electrolysis of aqueous solutions of sodium chloride, and hydrogen and oxygen obtained by water electrolysis, are produced in plants comprising a large number of electrolyzers electrically connected in series to an electric power source. When one of these electrolyzers needs maintenance, a suitable jumper switch means is connected to the electrolyzers immediately preceding and following the electrolyzer to be by-passed so that a low resistance path is formed which is preferentially flown by electric current. In this way the by-passed electrolyzer, wherein electric current no more travels, is shut down and removed from the row to be sent to maintenance. The electric current continues to travel through the electrolyzers circuit and, in correspondence of the point where the electrolyzer has been removed, it flows through the jumper switch means. When maintenance is over, the serviced electrolyzer is positioned again in the row and electrically connected through the relevant connections to the immediately preceding and following electrolyzers. Then the jumper switch means is disconnected following a sequence of operations allowing electric current to be fed again to the serviced electrolyzer.

The connection of the jumper switch means, which is the initial stage of the removal of the electrolyzer to be serviced, poses several problems. The first of these problem is related in particular to high current monopolar electrolyzers, wherein connection of the jumper switch means may cause a current shift which may damage the internal components of the electrolyzers immediately preceding and following the electrolyzer to be bypassed. This problem may be overcome as taught in U.S. Pat. Nos. 3,930,978–4,078,984 and in the European publication no. 0492551 A1, by using jumper switch means provided with multiple extension arms and positioned beneath the electrolyzers supporting base or above the electrolyzers, by means of cranes. Both configurations, which result from the presence of the multiple extension arms, permit also to solve the second problem typically affecting the jumper switch means of the prior art. These latter conventionally have the form of carts which can be moved along the supporting base of the electrolyzers and laterally with respect to the electrolyzers row. As the vertical size of said jumper switch means carts is remarkable, the electrolyzer to be serviced must be lifted and removed only by means of suitable cranes. This operation, besides requiring expensive equipment due to the remarkable weight of the electrolyzer, involves also a risk, as the electrolyzer is raised above both the rows of electrolyzers under operation and the operators themselves. For instance, leaks of liquids still present in the electrolyzer could have severe consequences.

If the jumper switch means is positioned beneath or above the electrolyzers, removal of one electrolyzer for maintenance may be made laterally by means of fork-lift trucks. However, positioning of the jumper switch means beneath or above the electrolyzers still involves very high costs due to more complex foundations or to the expensive structures required for the cranes.

A third problem is represented by the current reversal which crosses the electrolyzer to be bypassed when the electrolysis current is sent to the low resistivity circuit of the jumper switch means. This effect may be compared to the one characterizing the discharge of a charged condenser, when connected to a low resistivity circuit. The current reversal is particularly dangerous for the activated cathodes which are currently used in the electrolyzer, in particular for chlor-alkali and water electrolysis. The problem of reverse current has been faced in the prior art, for example see U.S. Pat. No. 4,589,966 wherein the jumper switch means are provided with suitably dimensioned resistor circuits which are inserted in a sequence with the progressive reduction of the current travelling across the electrolyzer to be by-passed and with the consequent reduction in its voltage. The voltage at the terminals of the jumper switch means, that is the contact points of the electrolyzer to be bypassed, is not brought to zero but it is kept at a minimum value, so-called polarization value, corresponding to the voltage spontaneously reached when current is no more fed. Under this condition, the electrolyzer is ready to function as a battery supplying current (reverse current) if the resistance of the external circuit, that is of the jumper switch means, is further reduced. To prevent this possibility, U.S. Pat. No. 4,589,966 foresees a suitable additional electrical circuit provided with other switches which are operated in a sequence. This circuit is undoubtedly effective, but it is expensive and complicated to be operated.

OBJECTS OF THE INVENTION

It is the main object of the present invention to provide for a novel type of jumper switch means comprising an internal resistor element comprising one or more internal bus bars dimensioned so as to decrease, once inserted, the voltage of the electrolyzer to be by-passed to a value below the voltage value spontaneously reached by the electrolyzer with no current flow. In this way the reverse current, although not eliminated, is remarkably reduced to negligible values without any risk.

It is another object of the present invention, to provide a jumper switch means with more than one internal bus bar to permit reducing progressively the electric current travelling across the electrolyzer during normal operation following a sequence of definite steps.

It is a further object of the present invention to provide for a novel jumper switch means wherein the internal bus bars are positioned in such a way that the jumper switch means has the form of a U wherein the vertical sections represent the connection terminals to the intercell contact points of the electrolyzers and the planar horizontal section houses the internal bus bars and has a very limited height with respect to the supporting base of the electrolyzers. This geometrical structure allows for easily removing laterally the electrolyzer to be sent to maintenance.

DESCRIPTION OF THE DRAWINGS

The invention will be now described in detail making reference to the drawings wherein.

DESCRIPTION OF THE INVENTION

Figure 1:
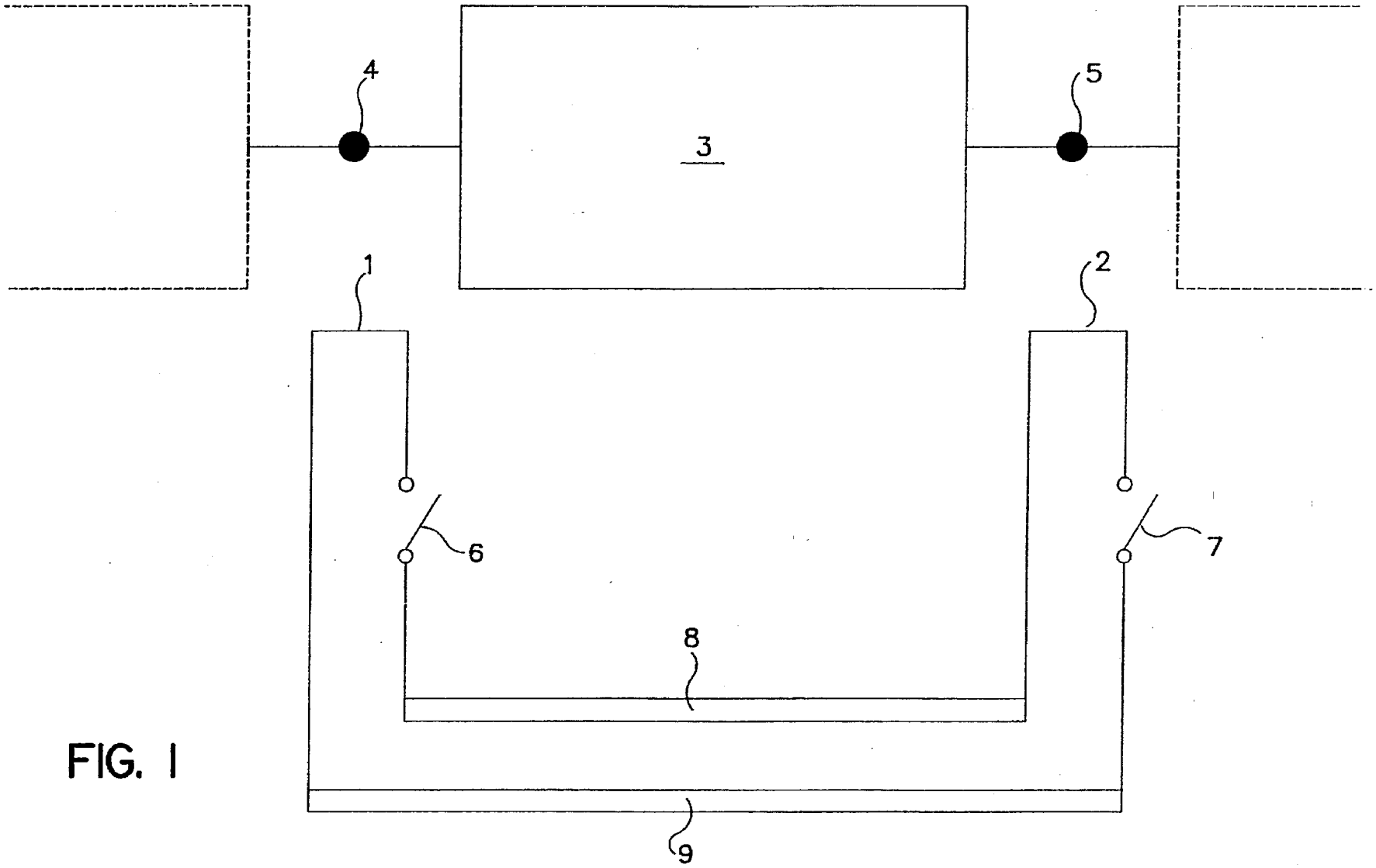
FIG. 1 is a simplified scheme of the preferred embodiment of the internal circuitry of the jumper switch means comprising two internal bus bars connected in parallel, each one connected to a switch.

FIG. 1 schematizes the preferred embodiment of the invention. In particular, reference numerals 1 and 2 indicate the connection terminals of the jumper switch means to the intercell contact points 4 and 5 bridging the electrolyzer 3, which is to be by-passed and removed from the electrolysis circuit. Switches 6 and 7 permit to insert the bus bars 8 and 9. In its industrial embodiment the jumper switch means actually has the same U shape as schematized in FIG. 1, with the switches housed in the two vertical sections and the bus bars housed in the planar section between the two vertical sections. The two bus bars 8 and 9 may be electrically connected one by one or at the same time, by suitably operating switches 6 and 7. If the bus bars 8 and 9 have a resistance R1 and R2 respectively, the total resistance of the jumper switch means obviously may be infinite (switches 6 and 7 in the open circuit position), R1 (switch 6 in the closed circuit position and switch 7 in the open circuit position), R2 (switch 6 in the open circuit position and switch 7 in the closed circuit position) and R1×R2/R1+R2 (switches 6 and 7 in the closed circuit position). Obviously this last possibility offers the minimum resistivity to the current flow, corresponding to the minimum voltage. Assuming that under this condition the current travelling across the electrolyzer corresponds to that flowing through the electrolysis circuit, the dimensioning of R1 and R2 depends only on the minimum voltage required at the connection terminals of the jumper switch means which voltage corresponds to that of the electrolyzer to be bypassed. According to the present invention, said minimum voltage should be close, but below the voltage that the electrolyzer would spontaneously reach, if allowed to do so, as soon as the current stops. If the natural voltage of the electrolyzer without current is indicated by Er, the difference between Er and the minimum voltage of the present invention is indicated by A and the current travelling across the electrolysis circuit is I, it results that R1×R2/R1+R2 is equal to (Er−A)/I. Generally A has a value comprised between 0 and 0.5 Volts, preferably between 0.1 and 0.3 Volts. The purpose of maintaining said minimum voltage at the connection terminals of the jumper switch means is to create the thermodynamic conditions to avoid formation of further electrolysis products when the jumper switch means is connected and the switches are set in the closed circuit position. This condition, which distinguishes the present invention over the prior art, eliminates from the electrolyzer the products accumulated inside thanks to the flow of fresh electrolyte which is continuously fed. Only when all the electrolysis products are withdrawn the addition of fresh electrolyte is stopped and the electrolyzer is disconnected from the various collectors, without risking release of dangerous products to the environment. This is particularly important in the chlor-alkali electrolysis where one of the products is chlorine, well-known as a danger for human safety. As the minimum short-circuiting voltage is kept below the Er value by a margin A which is rather small, the reverse current, even if not completely eliminated, is anyway maintained within minimum values, with substantially no negative effects. Said minimum reverse current tends to decrease down to practically zero with time, that is as the electrolyte contained in the electrolyzer is progressively replaced by fresh electrolyte without electrolysis products. Once the electrolyte in the electrolyzer is completely replaced, a residual current may flow in the same direction of the normal electrolysis current. In the case of chlor-alkali electrolysis, this residue current corresponds to a minimum water electrolysis reaction. It should be noted that in any case the electric power consumed in this residue process is negligible, in the order of Watts.

Therefore in this situation the intercell contact points of the electrolyzer may be disconnected without any risk for the operators and without any need to resort to additional and expensive circuitry.

Taking into consideration a real situation such as industrial plants for membrane or diaphragm chlor-alkali electrolysis, for example made of monopolar electrolyzers connected in series, it may be observed that the electrolyzers may show an average voltage of 3.0–3.5 Volts depending on the operating conditions and 2.2–2.3 Volts without current feed. In this case the jumper switch means of the present invention is provided with internal bus bars dimensioned in such a way as to provide for minimum voltages in the range of 1.8–1.9 Volts when the jumper switch means is crossed by the total amount of current fed to the electrolysis circuit.

It is therefore evident that the apparatus of the present invention strictly speaking could not be defined as a jumper switch means even if it is called like that in the present specification for simplicity sake. In fact, the apparatus of the present invention is directed to withdraw all or substantially all the electrolysis current, without giving rise to a real short-circuit of the electrolyzer to be bypassed as it is known in the prior art but maintaining instead a definite voltage value, as previously illustrated.

In the preferred embodiment of FIG. 1, R1 and R2 may have the same values. In this case, when the jumper switch means is connected to the intercell contact points of the electrolyzer to be removed, by turning switch 6 or switch 7 to the closed circuit position, a portion of the electrolysis current is deviated to the jumper switch means, the amount of such electrolysis current depending on the type of process and of electrolyzer. Just as an example, said portion in the case of membrane chlor-alkali electrolyzers may be equal to 80% of the total electrolysis current, which means that 20% of the total current still flows through the electrolyzer. When the second switch is also turned to the closed circuit position, the total resistance of the jumper switch means reaches the aforesaid value of R1×R2/R1+R2 and allows the total current to travel across the jumper switch means still maintaining at the intercell contact points of the electrolyzer the voltage necessary to minimize the current reversal and avoid formation of further electrolysis products. At this point the electrolyzer to be removed may be disconnected from the intercell contact points without any risk for the operator as the electric power actually fed to the electrolyzer is substantially negligible. After disconnection from the various collectors for distribution and collection of the electrolyte and gases, the electrolyzer may be removed and sent to the maintenance area. For long-term maintenance, most preferably one or more copper bus bars should be inserted among the intercell contact points which are set free, in order to avoid wasting energy due to heat generation (Joule effect) in the jumper switch means circuit. The same result may be obtained by a short-circuit switch installed inside the jumper switch means and not shown in FIG. 1. However, in the alternative based on the use of the copper bus bars is in any case preferable as it permits to disconnect the jumper switch means which may thus be used again to remove a further electrolyzer, if necessary. Obviously the above operations are repeated in the reverse sequence when the electrolyzer, after maintenance, must be re-inserted in the electrolysis circuit. The step-by-step withdrawal of the current travelling across the electrolyzer before removal and the subsequent step-by-step re-feeding when starting up the electrolyzer, after maintenance, is preferable as it permits to characterize the electrolyzer as described in U.S. Pat. No. 5,015,345 and to make less severe the transitory conditions affecting certain internal components, such as for example the ion exchange membranes. In order to maximize the possibility of characterizing the electrolyzer and to afford further protection against the severe transitory conditions of shut-down and start-up operations, the current decrease or increase are preferably carried out through a high number of steps. In this case the number of internal bus bars and relevant switches may be increased until the desired result is obtained. It should be noted that also in the embodiment illustrated in FIG. 1 the electrolysis current may be decreased or increased through two definite steps, just by suitably dimensioning the internal bus bars 8 and 9 so that the respective internal electrical resistances R1 and R2 are different. In any case, according to the present invention the value of R1×R2/R1+R2 must have the previously discussed value. It is also clear that a simpler embodiment of the present invention is also possible by resorting to only one internal bus bar suitably dimensioned in order to have the same resistance as already stated for R1×R2/R1+R2. In this case obviously the electrolysis current is either immediately brought to zero or fed at 100% load at the shut-down or start-up respectively, without any possibility of characterizing the electrolyzer or protecting the internal components during the transitory period.

From the above discussion it is soon clear that the internal bus bars of the jumper switch means of the present invention, when crossed by the electrolysis current, must be characterized by an ohmic drop equal to the voltage which, as already said, must be kept at the intercell contact points of the electrolyzer to be removed. In order to obtain the best result both from a technical and an economical standpoint, the bus bars should preferably consist in hollow bars with a quadrangular or circular cross-section obtained for example by extrusion. In this case the resistance R of a bus bar is given by the equation $R=r\times l/S$ where r is the specific resistivity of the construction material, l is the length of the bus bar and S is the available section for the passage of current, which is a function of the thickness of the bus bar wall. In particular, the construction material may be copper or preferably aluminium, which is commercially available in the form of extruded hollow bars with different dimensions and thicknesses of the wall. In order to have the widest choice of sections for the passage of current, it may result convenient fabricating the bars by longitudinal welding of L-shaped bars. Cooling water flows inside the hollow bars (the connections to the cooling circuit are not shown in FIG. 1) in order to maintain the temperature of the bus bars within predetermined limits. By suitably dimensioning the total cross-section of the bars and the thickness of the walls, a suitable volume of cooling water is provided so that adequate control of the temperature may be ensured for a sufficient time also in case of decrease or interruption of the water flow. Alternatively, the cooling water may flow at the outside along the bus bars, which in this case may be made of solid metal in, in the free space between the bus bars and the wails of the jumper switch means. This solution, if technically equivalent to the previous one as regards the temperature control, is however less preferred as it greatly reduces the electrical insulation with respect to the environment. In fact in this case it is necessary either to coat the internal face of the metal walls of the jumper switch means with insulating material or to make said walls in plastic material, with all the consequent risks of deformation or decay of their mechanical properties with time.

Figure 2:
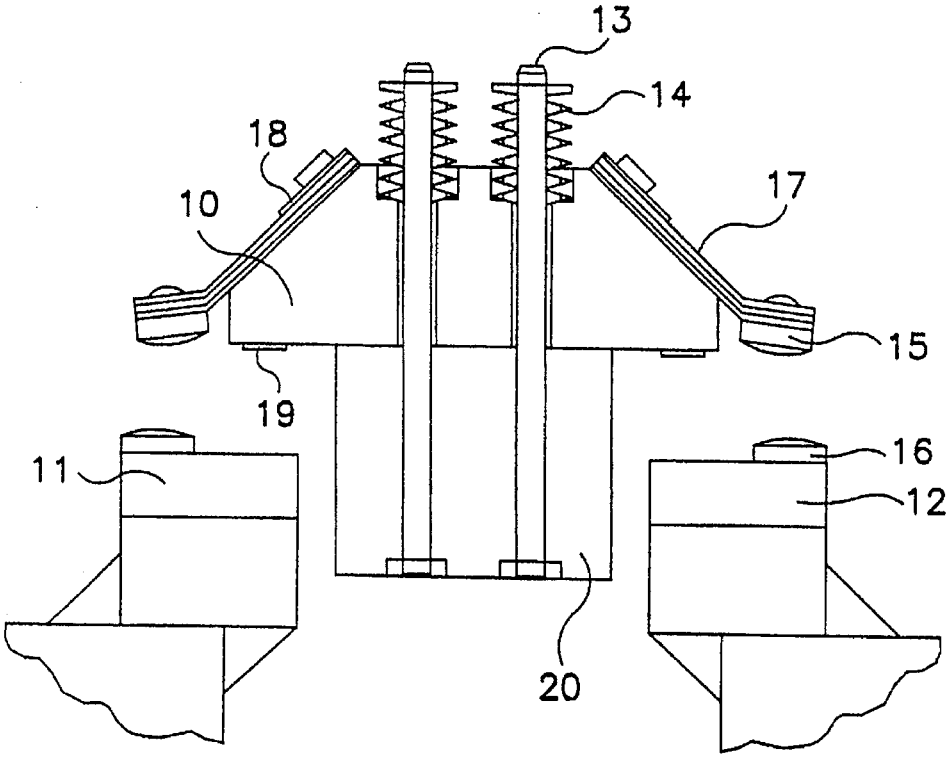
FIG. 2 is a scheme of one of the switches in the "open circuit" position.
Figure 3:
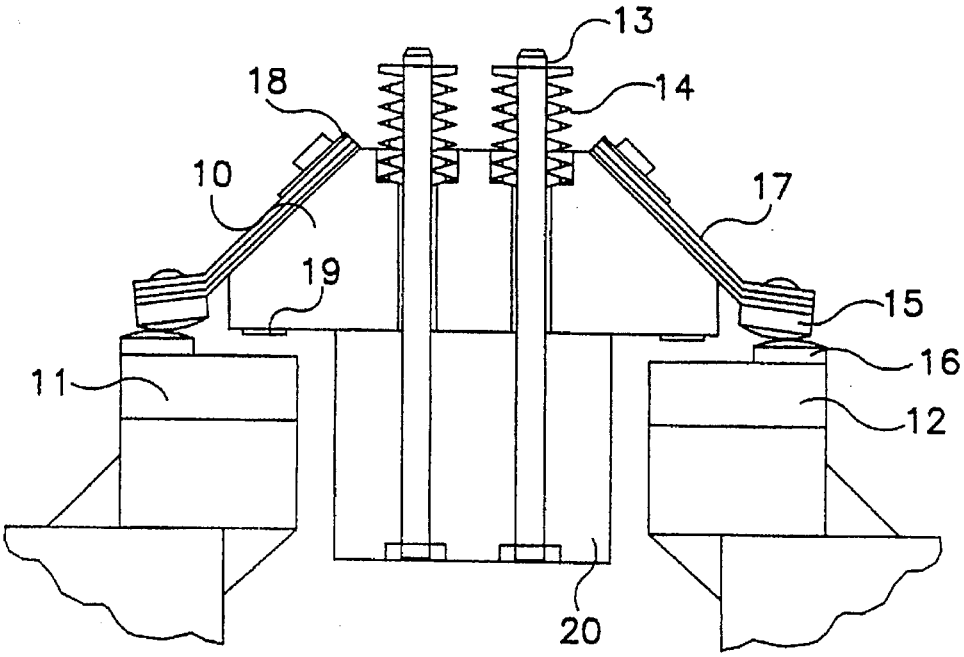
FIGS. 3 and 4 show the switch of FIG. 2 in the "closed circuit" position, partial and total respectively.
Figure 4:
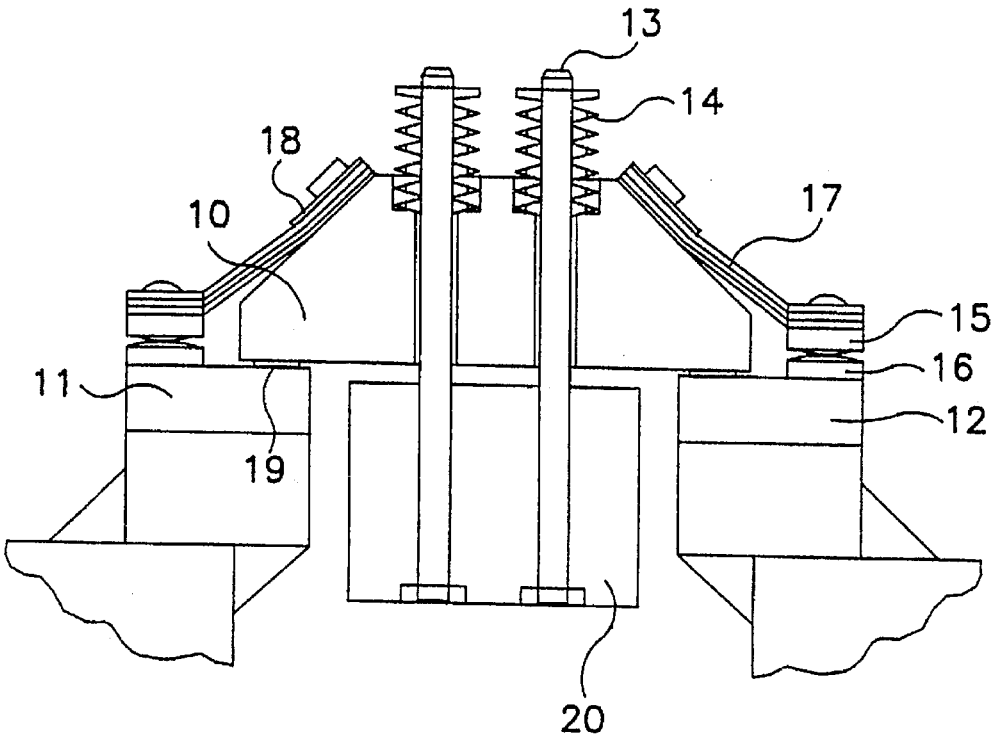
Figure 5:
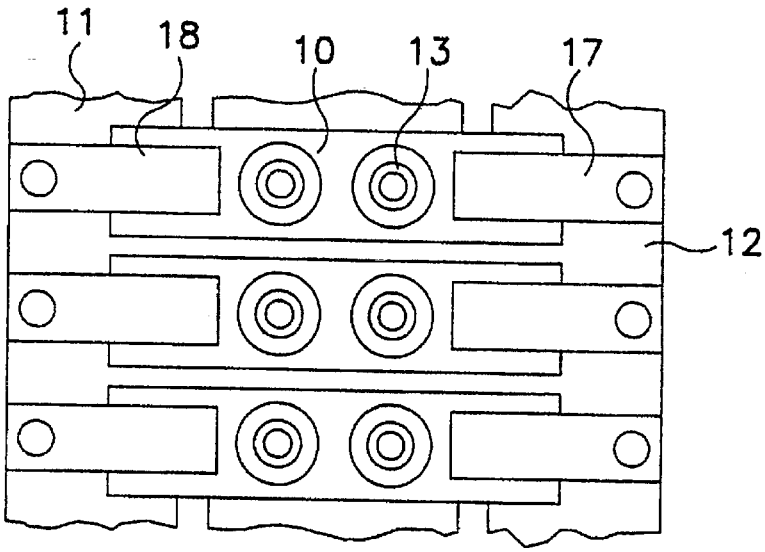
FIG. 5 shows a top view of an array of closely packed switches.

Switches 6 and 7 of FIG. 1 advantageously have the compact structure illustrated in FIG. 2 ("open circuit" position), FIG. 3 (intermediate "closed circuit" position) and FIG. 4 (final "closed circuit" position). In particular reference numeral 10 indicates the conductor body acting as a bridge between contacts 11 and 12 (which represent connections 1–6 or 2–7 in FIG. 1). Guide rods 13 and springs 14 permit to transfer a definite pressure onto contacts 11 and 12. Flexible lamellar sheets 17 and 18 keep under pressure sacrificial contacts 15 and 16 before main contacts 19 close the circuit. Conductor body 10 is moved by push block 20. The operation of the switch may be summarized as follows: starting from the "open circuit" position (FIG. 2), a pressure is exerted on push block 20 by a suitable device, for example of the pneumatic type. Push block 20 causes the displacement of conductor body 10 towards the contacts 11 and 12. The first partial closing of the circuit takes place when the sacrificial contacts 15 and 16 get in much and are progressively brought under pressure by flexible sheets 17 and 18 (FIG. 3). The further movement of the push block 20 causes the shut down of the circuit (minimum electrical resistance) when the main contacts 19, 11 and 12 are mutually compressed by the pressure exerted by guide rods 13 and springs 14 (FIG. 4). The same procedure is repeated in the reverse sequence when opening the circuit. The above described switches usually transmit only a portion of the electrolysis current which may be in the range of many kiloAmperes. For this reason the switches are used in closely packed arrays as shown in FIG. 5. It must be noted that the array of switches requires that each main contact be protected by a sacrificial contact. This characteristic plays an important role in the opening sequence, as under these conditions the extra-currents are also equally divided by a multiplicity of sacrificial contacts. The latter, therefore, are moderately consumed and require substitution only after substantially longer times than those of analogous devices of the prior art characterized by a number of sacrificial contacts substantially lower than the number of the main contacts. It must be remembered in fact that the consumption of an electrical contact during opening is mainly a function of the involved electric power. As the electric power is proportional to the square of the current intensity, it is evident that the division of the total extra-current in n portions, each one having an of intensity reduced by n times, causes a reduction of the power by a factor $n^2$.

Figure 6:
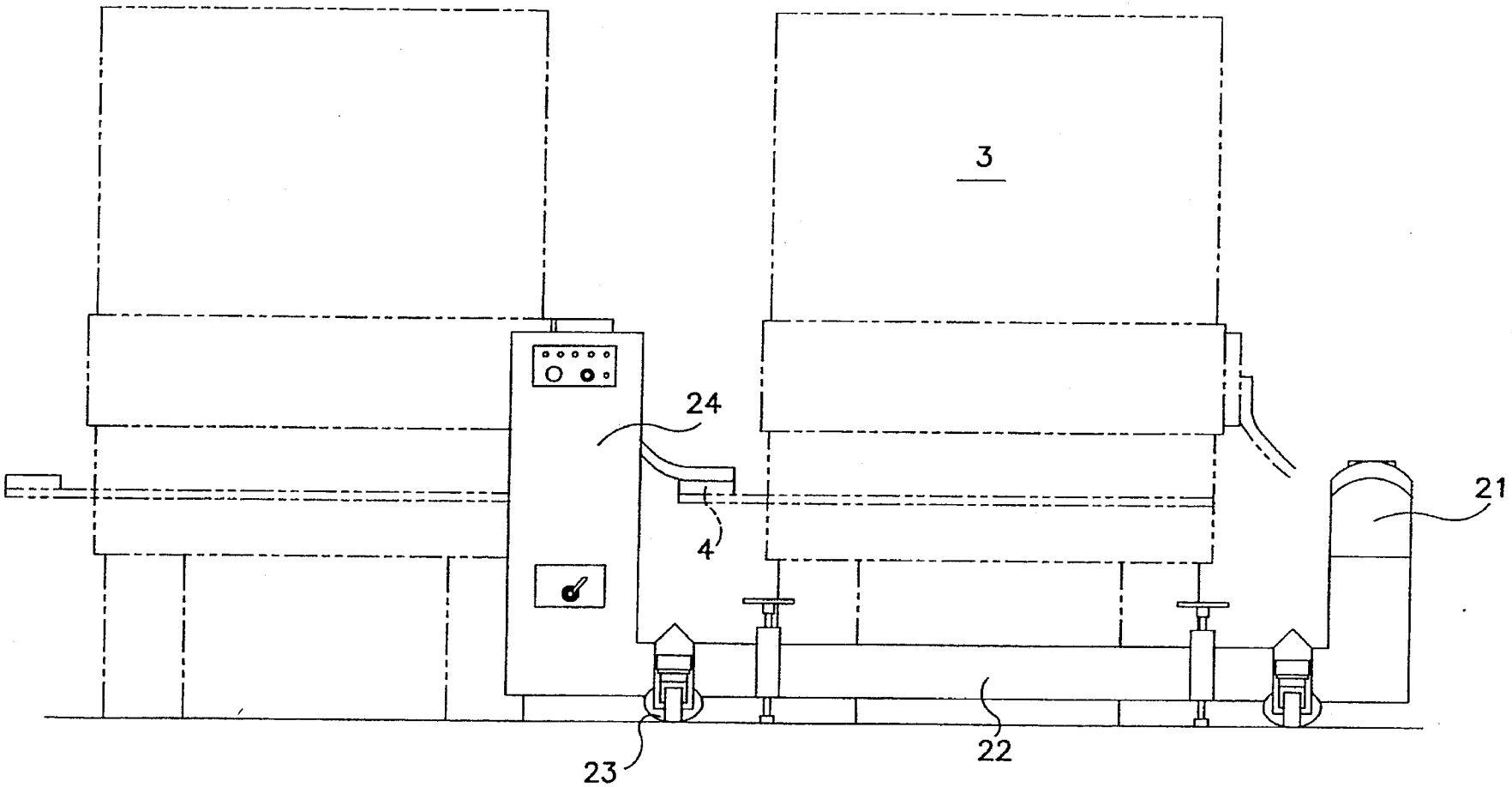
FIG. 6 shows a view of the U structure of the jumper switch means of the invention with the planar section having a limited height not to hinder the lateral removal of the electrolyzer. The planar section contains the internal bus bars while the two vertical sections contain the array of switches.

FIG. 6 shows the typical U shape of the jumper switch means of the present invention. One or both vertical sections 24 and 21 house the arrays of switches shown in FIG. 5, while the planar section 22 houses the bus bars 8 and 9 of FIG. 1, previously illustrated. The figure does not show the connections to the cooling circuit directed to maintain within predetermined limits the temperature of bus bars, connections of the internal bus bars to the arrays of switches and connections to the intercell contact points 4 of electrolyzer 3 to be removed for maintenance. The jumper switch means is provided with wheels 23 which permit easy movement along the row of electrolyzers connected in electrical series.

As it is clear from FIG. 6, the height of the planar section 22 with respect to the supporting base of the wheels 23 is extremely reduced as the planar section is directed to house the internal bus bars only. As a consequence the lateral removal of the electrolyzer 3 to be sent to maintenance is extremely easy and may be carried out by means of various equipment, in the simplest case by a fork-lift. To facilitate the use of such a lift, the jumper switch means of the invention may be modified as concerns the planar section by suitably adapting the bus bars and thus the planar section itself to form a U in the horizontal direction which can penetrate below the electrolyzer to be removed between its foundations. In this way the space between the vertical sections housing the arrays of switches can be kept completely free and allows the fork lift to get closer to the electrolyzer to be removed.

I claim:

1. A method for by-passing electric current in a monopolar electrolyzer to be removed for maintenance from a row of monopolar electrolyzers for chlor-alkali production, said electrolyzer being connected to collectors for distribution of electrolytes and collection of electrolysis products, said method consisting of using a jumper switch means comprising an internal resistor element made of one or more bus-bars connected to one or more switches, characterized in that said method comprises:

connecting the jumper switch means, having said bus-bars housed in a central planar section to the intercell contact points of said electrolyzer; turning the switches to the closed position with the insertion in sequence of the bus-bars and the step-by-step passage of the electric current in the jumper switch means up to obtaining the passage of said electric current with a voltage at the intercell contact points lower than the natural voltage spontaneously reached by the electrolyzer when the electric current is cut off, a residual current for a minimum water electrolysis still flowing across said electrolyzer;

flowing fresh electrolytes through said electrolyzer until the electrolysis products accumulated inside said electrolyzer are eliminated;

stopping the flow of fresh electrolyte through said electrolyzer and disconnecting said electrolyzer from the collectors and from the intercell contact points, removing laterally said electrolyzer out of the row of the electrolyzers by sliding it above said planar section;

short-circuiting the intercell contact points.

2. A jumper switch means for by-passing electric current in a monopolar electrolyzer to be removed for maintenance from a row of monopolar electrolyzers for chlor-alkali production, said jumper switch means being positioned laterally along said row of electrolyzers and including an internal resistor element consisting of one or more bus-bars connected to one or more switches, characterized in that a) said jumper switch means comprises two vertical side sections and one planar flat section which form a U-shape, b) the distance between said vertical side sections is longer than the width of said electrolyzer, c) said planar flat section has a height lower than the free spacing below said electrolyzer to allow for the lateral removal of said electrolyzer by sliding it over the planar flat section, d) said switches are housed in one or both the vertical sections, e) said bus-bars are housed in the planar flat section.

* * * * *